US008348688B2

(12) United States Patent
Liu et al.

(10) Patent No.: US 8,348,688 B2
(45) Date of Patent: Jan. 8, 2013

(54) WATERPROOF CONNECTOR

(75) Inventors: Zhen Liu, Tu Cheng (TW); Wei-hong Liao, Tu Cheng (TW); Ming-chiang Chen, Tu Cheng (TW)

(73) Assignee: Cheng Uei Precision Industry Co., Ltd., Tu Cheng, Taipei (TW)

( * ) Notice: Subject to any disclaimer, the term of this patent is extended or adjusted under 35 U.S.C. 154(b) by 311 days.

(21) Appl. No.: 12/938,322

(22) Filed: Nov. 2, 2010

(65) Prior Publication Data

US 2012/0108095 A1 May 3, 2012

(51) Int. Cl.
*H01R 13/52* (2006.01)

(52) U.S. Cl. ..... 439/271

(58) Field of Classification Search ..... 439/271, 439/607.27, 731

See application file for complete search history.

(56) References Cited

U.S. PATENT DOCUMENTS 5,222,909 A * 6/1993 Nomura et al. ..... 439/607.01
6,059,581 A * 5/2000 Wu ..... 439/79
7,922,535 B1 * 4/2011 Jiang et al. ..... 439/607.35
8,052,467 B1 * 11/2011 Xie et al. ..... 439/589

* cited by examiner

*Primary Examiner* — Vanessa Girardi
(74) *Attorney, Agent, or Firm* — Cheng-Ju Chiang

(57) ABSTRACT

Provided is a waterproof connector, including an inner insulating housing, a plurality of electrical contacts, an inner metal shell, a sealing plate, an outer insulating housing, an outer metal shell and a waterproof rubber ring. The inner metal shell is pressed to form a plurality of holding blocks and two holes. The sealing plate includes a connecting plate and two closing plates for covering the corresponding hole. The outer insulating housing is integrally formed with the inner insulating housing, the electrical contacts, the inner metal shell and the sealing plate by insert molding. The waterproof rubber ring encompasses a front end of the inner metal shell. The outer insulating housing can seal off the gaps between the sealing plate and the inner metal shell, and between the inner insulating housing and the inner metal shell. The present waterproof connector can satisfy the waterproof demand by the waterproof rubber ring.

5 Claims, 6 Drawing Sheets

WATERPROOF CONNECTOR

BACKGROUND OF THE INVENTION

1. Field of the Invention

The present invention relates to a connector, and more particularly to a waterproof connector.

2. Description of the Prior Art

Please refer to FIGS. 7 and 8, a prior connector 8 comprises an insulating housing 81, a plurality of electrical contacts 82 fixed on the insulating housing 81, and a metal shell 83 covering the insulating housing 81. The insulating housing 81 has a front wall 811, a back wall 812, a top wall 813, a bottom wall 814 and two sidewalls 815. The insulating housing 81 disposes a plate-type retaining portion 816 protruding forward from the front wall 811, and a plurality of contact-receiving grooves (not shown in all FIGS) formed on the retaining portion 816 and extending backward from a front end of the retaining portion 816 to pass through the insulating housing 81. The electrical contacts 82 are separately retained in the corresponding contact-receiving grooves. The metal shell 83 covers the insulating housing 81 for shielding electromagnetic interference.

However, the above prior electrical connector 8 has a bad waterproof property because of the gap existed between the insulating housing 81 and the metal shell 83. The moisture easily enters into the inner of the electrical connector 8 so that causing short circuit and affecting the signal-transmitting quality.

BRIEF SUMMARY OF THE INVENTION

An object of the present invention is to provide a waterproof connector, capable of enhancing the waterproof property.

To achieve the above object, in accordance with the present invention, a waterproof connector is provided, comprising an inner insulating housing, a plurality of electrical contacts, an inner metal shell, a sealing plate, an outer insulating housing, an outer metal shell and a waterproof rubber ring. The electrical contacts are embedded in the inner insulating housing by insert molding. The inner metal shell has a top plate, a bottom plate and two side plates. The top plate is pressed to form a plurality of holding blocks projecting outward thereon. Both of the two side plates are pressed to separately form at least one holding block projecting outward thereon. The top plate is punched to form two holes on a middle portion thereof. The bottom plate forms a rectangular projecting portion projecting outward on a middle portion thereof. The inner metal shell is mounted on the inner insulating housing, and forms a receiving space surrounding the inner insulating housing. The sealing plate includes a connecting plate and two closing plates separately extending from two ends of the connecting plate. Each one of the two closing plates disposes a closing shell on a middle portion thereof. The sealing plate is pressed against the top plate of the inner metal shell. The covering shell covers upon the corresponding hole of the top plate, and the closing plate further seals off the periphery of the corresponding hole of the top plate. The outer insulating housing has an upper wall, a lower wall and two vertical walls. The outer insulating housing is integrally formed with and encompasses the inner insulating housing, the electrical contacts, the inner metal shell and the sealing plate by insert molding. The outer metal shell covers the outside of outer insulating housing and a back portion of the inner insulating housing. The waterproof rubber ring is arranged to encompass a front end of the inner metal shell.

Based on the above description, the waterproof connector of the present invention comprises the inner metal shell, which is pressed to form a plurality of holding blocks. The present waterproof connector employs the sealing plate to cover the holes of the top plate of the inner metal shell. The present outer insulating housing is integrally formed with and encompasses the inner insulating housing, the electrical contacts, the inner metal shell and the sealing plate by insert molding, thereby sealing off the gaps between the sealing plate and the inner metal shell, and between the inner insulating housing and the inner metal shell. Moreover, the present waterproof connector can satisfy the waterproof demand because of the sealing function provided by the waterproof rubber ring.

DETAILED DESCRIPTION OF THE PREFERRED EMBODIMENTS

The following embodiment with reference to the accompanying drawings now has been given for detail describing the technology, the feature, the object and the effect of the present invention.

Figure 1:
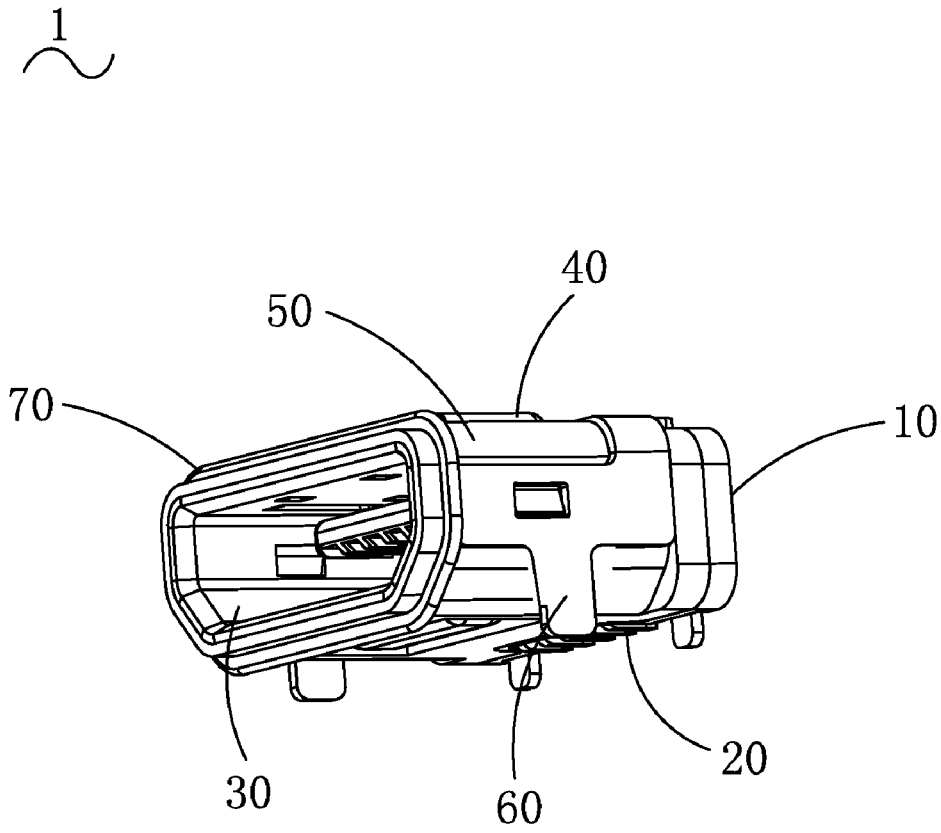
FIG. 1 is a perspective view of a waterproof connector according to one embodiment of the present invention.

Referring to FIG. 1, a waterproof connector 1 of the present invention comprises an inner insulating housing 10, a plurality of electrical contacts 20, an inner metal shell 30, a sealing plate 40, an outer insulating housing 50, an outer metal shell 60 and a waterproof rubber ring 70.

Figure 2:
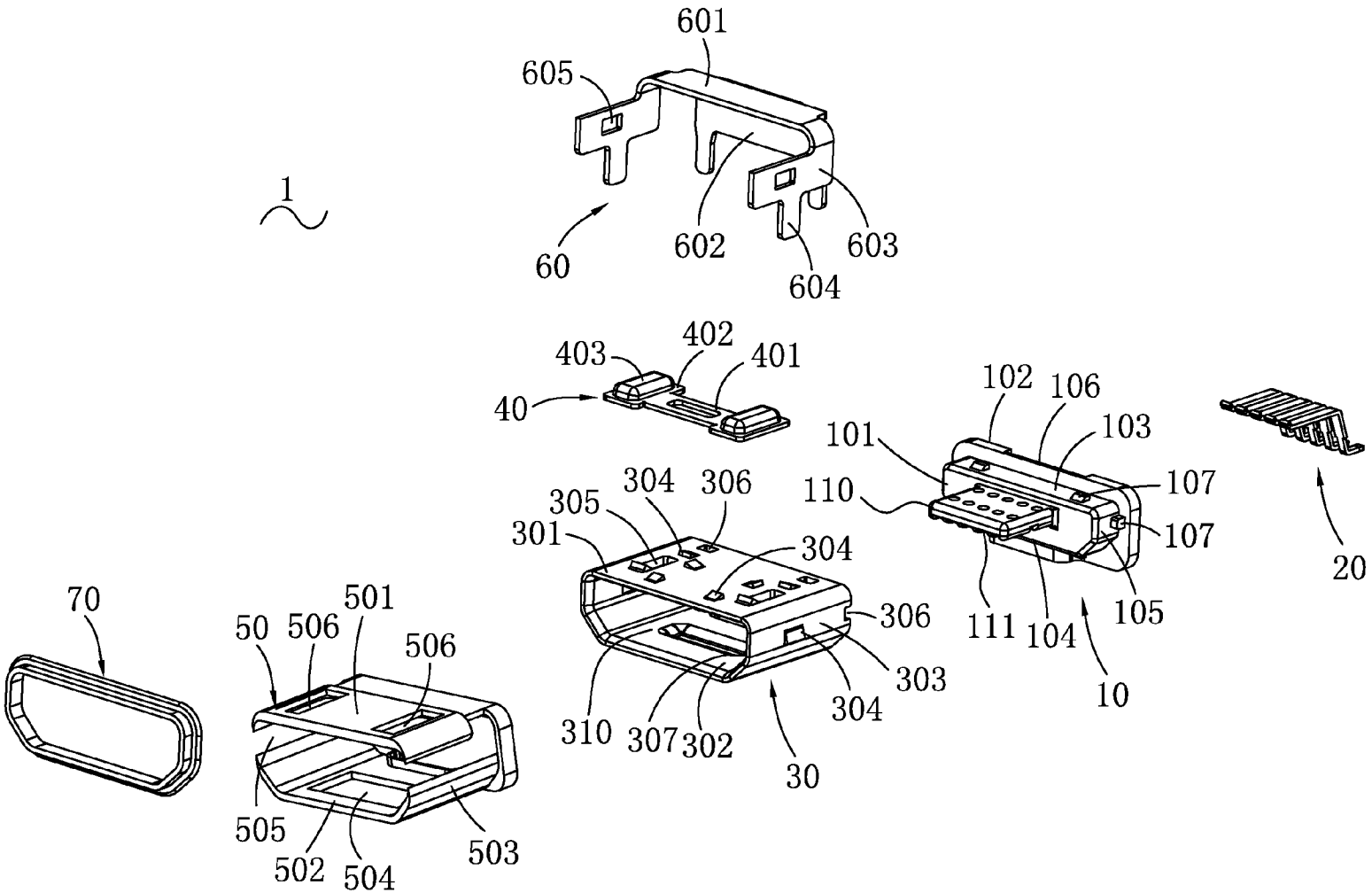
FIG. 2 is an exploded perspective view of the waterproof connector of FIG. 1.
Figure 5:
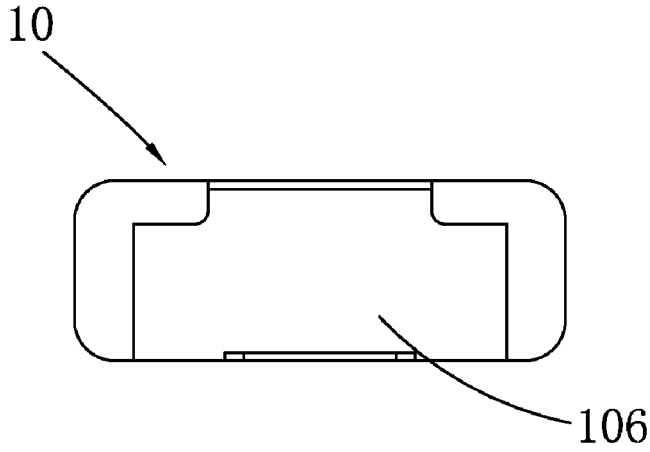
FIG. 5 is a back plane view of an inner insulating housing of the waterproof connector of FIG. 2.

Referring to FIGS. 2 and 5, the inner insulating housing 10 is a whole structure made by injection molding, and has a front wall 101, a back wall 102, a top wall 103, a bottom wall 104 and two sidewalls 105. The inner insulating housing 10 disposes a plate-type retaining portion 110 protruding forward from the front wall 101. The retaining portion 110 forms a plurality of contact-receiving grooves 111 extending backward from a front end thereof and passing through the inner insulating housing 10. The inner insulating housing 10 also disposes a recess 106 (as shown in FIG. 5) being formed on the back wall 102 and extending up and down, and several locking portions 107 separately projecting on a middle portion of the top wall 103, a middle portion of the bottom wall 104 and middle portions of the two sidewalls 105.

The electrical contacts 20 are placed in a mould so that the inner insulating housing 10 can be integrally formed with the electrical contacts 20 by insert molding, and the electrical contacts 20 are embedded in the inner insulating housing 10.

Referring to FIG. 2, the inner metal shell 30 is mounted on and surrounds the inner insulating housing 10, and has a top plate 301, a bottom plate 302, two side plates 303 and a receiving space 310 defined by these plates 301, 302, 303. The top plate 301 disposes several holding blocks 304 projecting thereon. Each of the two side plates 303 disposes at least one holding block 304 projecting thereon. The top plate 301 further forms two rectangular holes 305 on a middle portion thereof. The top plate 301, the bottom plate 302 and the two side plates 303 separately dispose at least one locking opening 306 on back portions thereof for corresponding to the locking portions 107. The bottom plate 302 is punched to form a rectangular projecting portion 307 projecting outward on a middle portion thereof. The locking portions 107 of the inner insulating housing 10 separately enter into and engaged with the corresponding locking openings 306 so as to make the inner insulating housing 10 be retained in the receiving space 310.

Figure 4:
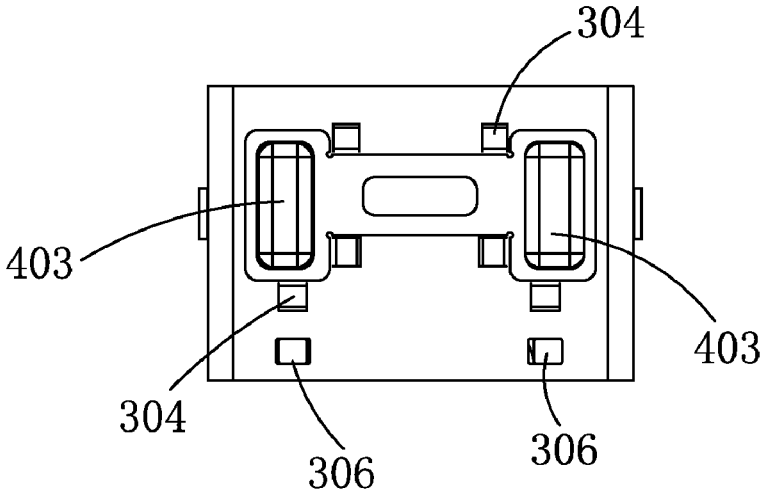
FIG. 4 is a top plane view of the waterproof connector of FIG. 3.

Referring to FIGS. 2 and 4, the sealing plate 40 comprises a connecting plate 401 and two closing plates 402 separately extending from two ends of the connecting plate 401. Each one of the two closing plates 402 disposes a closing shell 403 on a middle portion thereof. The connecting plate 401 of the sealing plate 40 is clipped between the holding blocks of the top plate 301 of the inner metal shell 30. The two covering shells 403 separately cover upon the two rectangular holes 305. The closing plates 402 separately seal off the peripheries of the two rectangular holes 305.

Please refer to FIG. 2, the outer insulating housing 50 is integrally formed with the inner insulating housing 10, the electrical contacts 20, the inner metal shell 30 and the sealing plate 40 by insert molding and encompasses them. The outer insulating housing 50 has an upper wall 501, a lower wall 502 and two vertical walls 503. The upper wall 501 forms two holding holes 506 separately corresponding to the closing shells 403. The lower wall 502 forms a rectangular opening 504 corresponding to the projecting portion 307. When the outer insulating housing 50 covers the inner metal shell 30, the rectangular projecting portion 307 enters into the rectangular opening 504. The vertical wall 503 forms a latch groove 505 extending along a front-to-back direction on a middle portion thereof.

Figure 6:
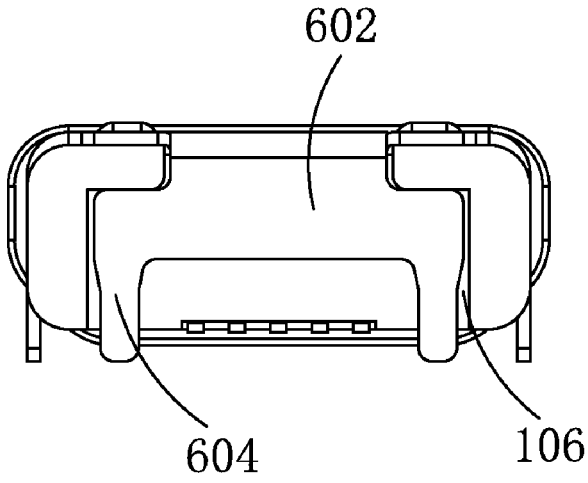
FIG. 6 is a back plane view of the waterproof connector of FIG. 1.
Figure 7:
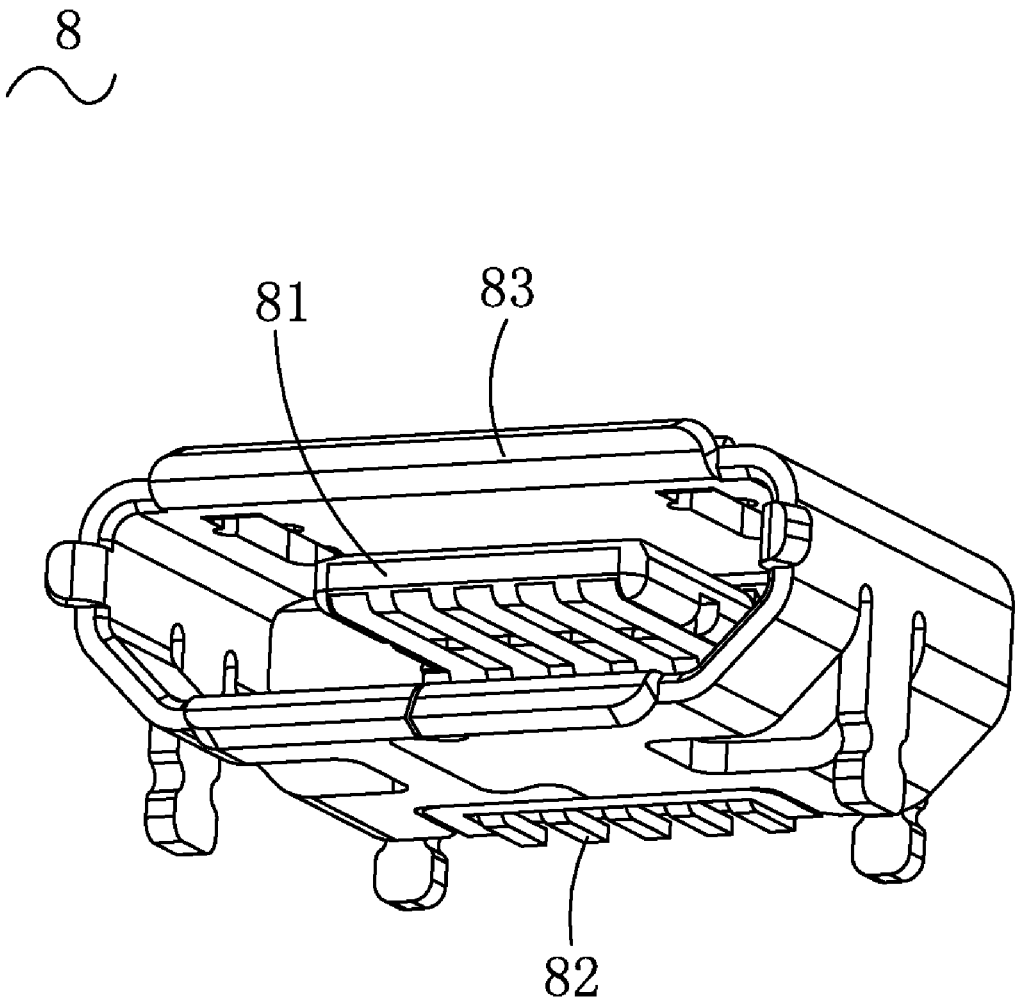
FIG. 7 (PRIOR ART)
FIG. 7 is a perspective view of a prior electrical connector.
Figure 8:
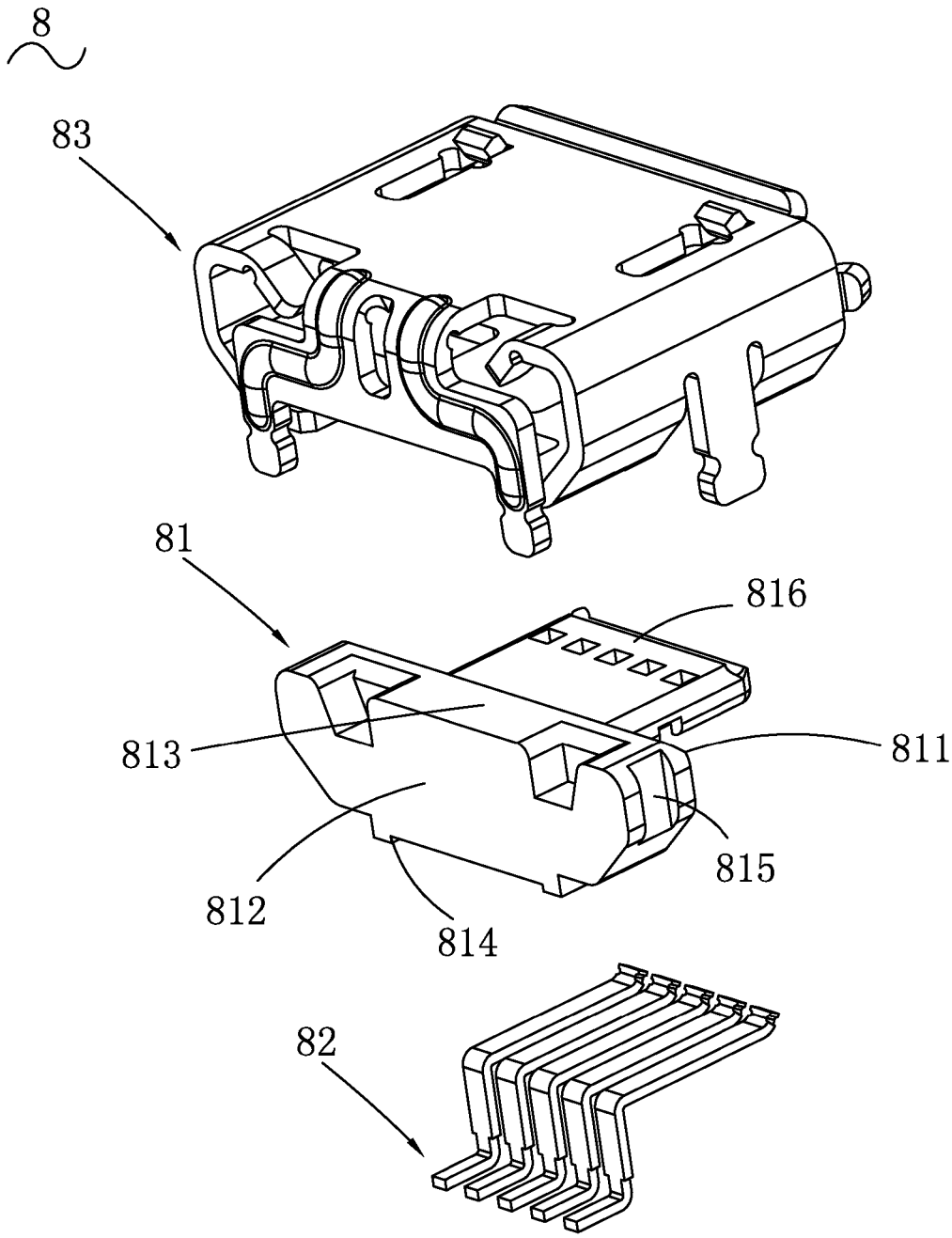
FIG. 8 (PRIOR ART)
FIG. 8 is an exploded perspective view of the prior electrical connector of FIG. 7.

Please refer to FIGS. 2 and 6 again, the outer metal shell 60 has a top cover 601, a back cover 602 perpendicularly bent from one back edge of the top cover 601 and extending downward, and two side covers 603 separately and perpendicularly bent from two side edges of the top cover 601 and extending forward and downward. Both of the two side covers 603 separately form a soldering foot 604 extending downward from a middle portion thereof, and a positioning hole 605 on the middle portion thereof. When the outer metal shell 60 covers the outer insulating housing 50, the top cover 601 covers a back portion of the outer insulating housing 50, the back cover 602 is held in the recess 106 of the inner insulating housing 10, the two side covers 603 separately cover the two vertical walls 503 of the outer insulating housing 50, and the holding block 304 of the side plate 303 of the inner metal shell 30 passes through the corresponding the latch groove 505 to be held into the positioning hole 605 of the outer metal shell 60.

Figure 3:
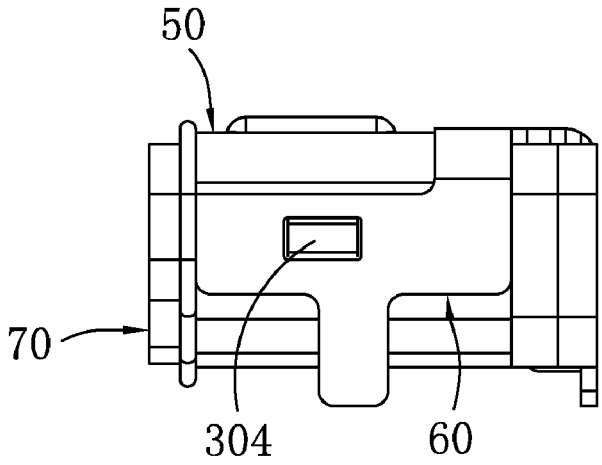
FIG. 3 is a right side view of the waterproof connector of FIG. 1.

Referring to FIGS. 2 and 3, the waterproof rubber ring 70 surrounds a front end of the inner metal shell 30, and the thickness of the waterproof rubber ring 70 is larger than that of the outer insulating housing 50.

When assembling the waterproof connector 1, first the electrical contacts 20 are placed in one mould so that the inner insulating housing 10 can be integrally formed with the electrical contacts 20 by means of insert molding and the electrical contacts 20 are embedded in the inner insulating housing 10. Next, the inner metal shell 30 is mounted around the inner insulating housing 10. Then, the sealing plate 40 is mounted on the inner metal shell 30 and covers the two holes 305. The inner insulating housing 10, the electrical contacts 20, the inner metal shell 30 and the sealing plate 40, having been assembled together, are placed into one mould, so that the outer insulating housing 50 can be integrally formed with them by insert molding. After insert molding, the two closing shells 403 are protruding out of the upper wall 501 of the outer insulating housing 50, the projecting portion 307 is extending out of the lower wall 502 of the outer insulating housing 50, and the holding block 304 of each of the side plates 303 is protruding out of the corresponding vertical wall 503 of the outer insulating housing 50. Further, the holding blocks 304 of the top plate 301 are embedded into the outer insulating housing 50 for securing the outer insulating housing 50, and gaps between the locking portions 107 and the corresponding locking openings 306 are completely sealed off by the outer insulating housing 50. And then, the outer metal shell 60 is mounted on the outside of outer insulating housing 50 and the back portion of the inner insulating housing 10. Finally, the waterproof rubber ring 70 is arranged to encompass the front end of the inner metal shell 30.

As described above, the waterproof connector 1 of the present invention employs the sealing plate 40 to cover the holes 305 of the inner metal shell 30. The outer insulating housing 50 is integrally formed with the inner insulating housing 10, the electrical contacts 20, the inner metal shell 30 and the sealing plate 40 by insert molding thereby sealing off the gaps between the sealing plate 40 and the inner metal shell 30 and between the inner insulating housing 10 and the inner metal shell 30. Moreover, the waterproof rubber ring 70 seals off the receiving space 310 so that satisfying the waterproof demand.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A waterproof connector comprising:

an inner insulating housing;

a plurality of electrical contacts, being embedded in the inner insulating housing by insert molding;

an inner metal shell, being mounted on the inner insulating housing, and having a top plate, a bottom plate and two side plates, wherein the top plate is pressed to form a plurality of holding blocks projecting outward thereon, both of the two side plates are pressed to separately form at least one holding block projecting outward thereon, the top plate is punched to form two holes on a middle portion thereof, and the bottom plate forms a rectangular projecting portion projecting outward on a middle portion thereof;

a sealing plate, including a connecting plate and two closing plates separately extending from two ends of the connecting plate, wherein each one of the two closing plates disposes a closing shell on a middle portion thereof, the sealing plate is pressed against the top plate of the inner metal shell, the covering shell covers upon the corresponding hole of the top plate, and the closing plate seals off the periphery of the corresponding hole of the top plate;

an outer insulating housing, having an upper wall, a lower wall and two vertical walls, and being integrally formed with and encompassing the inner insulating housing, the electrical contacts, the inner metal shell and the sealing plate by insert molding;

an outer metal shell, covering the outside of outer insulating housing and a back portion of the inner insulating housing; and a waterproof rubber ring, being arranged to encompass a front end of the inner metal shell.

2. The waterproof connector as claimed in claim 1, wherein the outer insulating housing disposes two holding holes separately corresponding to the closing shells of the sealing plate on the upper wall, an opening corresponding to the projecting portion of the inner metal shell on the lower wall, and a latch groove extending along a front-to-back direction on a middle portion of the vertical wall; after the outer insulating housing is formed by insert molding, the closing shells are protruding out of the upper wall of the outer insulating housing, the projecting portion of the inner metal shell is extending out of the lower wall of the outer insulating housing, the holding block of each one of the side plates is protruding out of the corresponding vertical wall of the outer insulating housing, and the holding blocks of the top plate are embedded into the outer insulating housing for securing the outer insulating housing.

3. The waterproof connector as claimed in claim 1, wherein the connecting plate of the sealing plate is clipped between the holding blocks of the top plate of the inner metal shell.

4. The waterproof connector as claimed in claim 1, wherein the inner insulating housing is a whole structure made by injection molding, and has a front wall, a back wall, a top wall, a bottom wall and two sidewalls; a plurality of locking portions are separately arranged on a middle portion of the top wall, a middle portion of the bottom wall and middle portions of the two sidewalls and protrude outward; the top plate, the bottom plate and the two side plates of the inner metal shell separately dispose at least one locking opening on back portions thereof; the locking portions of the inner insulating housing are separately enter into and engaged with the corresponding locking openings of the inner metal shell; and the gaps between the locking portions and the corresponding locking openings are sealed off by the outer insulating housing.

5. The waterproof connector as claimed in claim 1, wherein the thickness of the waterproof rubber ring is larger than that of the outer insulating housing.

* * * * *